US010644466B2

(12) United States Patent
Qin et al.

(10) Patent No.: US 10,644,466 B2
(45) Date of Patent: May 5, 2020

(54) COAXIAL CONNECTION SYSTEM FOR RF SIGNALS WITH HIGH RF PERFORMANCE LEVELS

(71) Applicants: RADIALL SA, Aubervilliers (FR); ROSENBERGER HOCHFREQUENZTECHNIK Gmbh & Co. KG, Tittmoning (DE); HUBER + SUHNER AG, Herisau (CH)

(72) Inventors: Shan Qin, Shanghai (CN); Peng Zhai, Shanghai (CN)

(73) Assignees: RADIALL SA, Aubervilliers (FR); ROSENBERGER HOCHFREQUENZTECHNIK GMBH & CO. KG, Titmioning (DE); HUBER + SUHNER AG, Herisau (CH)

( * ) Notice: Subject to any disclaimer, the term of this patent is extended or adjusted under 35 U.S.C. 154(b) by 0 days.

(21) Appl. No.: 15/477,652

(22) Filed: Apr. 3, 2017

(65) Prior Publication Data

US 2017/0271827 A1 Sep. 21, 2017

Related U.S. Application Data

(63) Continuation-in-part of application No. PCT/CN2016/070812, filed on Jan. 13, 2016.

(30) Foreign Application Priority Data

Jan. 9, 2017 (EP) ..... 17150703

(51) Int. Cl.
*H01R 24/40* (2011.01)
*H01R 13/622* (2006.01)
(Continued)

(52) U.S. Cl.
CPC ..... *H01R 24/40* (2013.01); *H01R 9/05* (2013.01); *H01R 13/24* (2013.01); *H01R 13/50* (2013.01);
(Continued)

(58) Field of Classification Search
CPC .... H01R 24/40; H01R 13/622; H01R 13/623; H01R 13/5202; H01R 13/434; H01R 9/05; H01R 9/0503
(Continued)

(56) References Cited

U.S. PATENT DOCUMENTS 4,697,859 A 10/1987 Fisher, Jr.
5,217,391 A * 6/1993 Fisher, Jr. ..... H01R 24/44 439/578
(Continued)

FOREIGN PATENT DOCUMENTS

CN 102484336 A 5/2012
CN 103597671 A 2/2014
CN 104641516 A 5/2015

OTHER PUBLICATIONS 4.3-10 Rosenberger, Web page, <https://www.rosenberger.com/0_documents/de/specs/com/64.pdf>, 2 pages, Oct. 30, 2015, retrieved from Internet Archive Wayback Machine <https://web.archive.org/web/20151030022938/https://www.rosenberger.com/0_documents/de/specs/com/64.pdf> on Jun. 25, 2018).*
(Continued)

*Primary Examiner* — Amy Cohen Johnson
*Assistant Examiner* — Paul D Baillargeon
(74) *Attorney, Agent, or Firm* — Oliff PLC

(57) ABSTRACT

The invention relates to a coaxial connection system in which solid insulating structures are used and it is provided a lengthening of the guide portion of the connectors, while ensuring an axial immobilization of the ground contacts
(Continued)

independently of the locking device that mechanically locks the plug to the jack when they are in mutual connection configuration.

9 Claims, 4 Drawing Sheets

(51) Int. Cl.

| | |
|---|---|
| ***H01R 9/05*** | (2006.01) |
| ***H01R 13/627*** | (2006.01) |
| ***H01R 13/631*** | (2006.01) |
| ***H01R 13/24*** | (2006.01) |
| ***H01R 13/50*** | (2006.01) |
| *H01R 103/00* | (2006.01) |
| *H01R 101/00* | (2006.01) |

(52) U.S. Cl.
CPC ..... *H01R 13/622* (2013.01); *H01R 13/6277* (2013.01); *H01R 13/631* (2013.01); *H01R 13/627* (2013.01); *H01R 2101/00* (2013.01); *H01R 2103/00* (2013.01)

(58) Field of Classification Search
USPC ..... 439/578, 585, 622, 623, 625
See application file for complete search history.

(56) References Cited

U.S. PATENT DOCUMENTS 6,024,609 A * 2/2000 Kooiman ..... H01R 24/40 411/433
8,496,495 B2 * 7/2013 Kari ..... H01R 13/6277 439/352
2016/0322751 A1 * 11/2016 Van Swearingen ..... H01R 13/642

OTHER PUBLICATIONS

Li Zhenyuan, "Microwave Measurement Technology in Travelling Wave Tubes," National Defense Industry Press, pp. 540-541, Dec. 31, 2013.
Jul. 18, 2018 Office Action issued in Chinese Application No. 201710025789.X.
Feb. 28, 2019 Office Action issued in Chinese Application No. 200710025789.X.
"Radio-Frequency Connectors," IEC61169-54 4.3-10, pp. 7-14, May 17, 2015.

* cited by examiner

COAXIAL CONNECTION SYSTEM FOR RF SIGNALS WITH HIGH RF PERFORMANCE LEVELS

TECHNICAL FIELD

The present invention relates to a coaxial connection system, intended in particular to transmit radio frequency RF signals.

The applications particularly targeted by the invention are the connection of telecommunication equipment such as base transceiver stations BTS, RRU/RRH (remote radio unit/remote radio head) units and distributed antenna system for the wireless communications market.

The invention also relates generally to the connection systems in the medical domain, the industrial domain, the aeronautical or transport domain and the space domain.

The invention more particularly aims to propose a connection system of coaxial type for which the electrical and mechanical RF performance levels are controlled and stable over time, with, in particular, a low contact resistance and a low intermodulation level.

PRIOR ART

The market and the prior art already feature power connectors of coaxial type for low passive intermodulation and dedicated to the telecommunications sector for cellular radio telephony infrastructures.

The trend in this market is to minimize the generation of passive intermodulation products. This is because, although the passive components, such as coaxial connectors and RF leads, were considered to be linear, it has been found that in reality these components were susceptible to behave as intermodulation generators, that is to say non-linear generators of unwanted modulation of the RF signals, which can lead to a distortion of the signals output from said components.

FIG. 1 shows, in longitudinal cross section, a coaxial power connection system which has been marketed for more than 30 years under the series 7/16 designation, as specified in the standard IEC 61169-4.

The jack 3 comprises a central contact 30 and a peripheral contact 31 arranged at the periphery of the central contact, forming a ground contact. Furthermore, a solid insulator which is not represented is interposed between the central contact and the ground contact, all these elements being housed in a body 32. In order to mechanically lock the mutual connection between plug and jack, a locking nut 4 was provided, to be screwed around both the plug and the jack.

The plug 2 itself comprises a central contact 20 and a peripheral contact 21 arranged at the periphery of the central contact, forming a ground contact.

In order to minimize the passive intermodulation, the axial abutment contact A on the longitudinal axis X of the connection system between the ground contacts 31 and 21 must be strong. It is guaranteed by a strong tightening screwing torque applied to the locking nut 4. This tightening torque is also needed to reduce the risks of unscrewing linked to the effects of stress and strain relaxation which appear in the lifecycle of the connector subject to temperature differences, vibrations, etc., which can in particular induce the unscrewing of the nut in case of insufficient torque: thus, the screwing torque is stronger than necessary in order to offer the maximum guarantee over time of the contact pressure between ground contacts and, through that, a low intermodulation level.

Thus, in a coaxial power connection system 1 according to FIG. 1, it is necessary:

- to engineer robust parts supporting the application of shear forces, such as the threads 34 and the nut 24, pulling forces, such as the body 32, and compression forces, such as the ground contact 31, these forces being generated by the strong screwing torque of the nut 24 on the threads 34,
- to use a bulky torque wrench to apply a significant and controlled screwing torque, typically 30 to 35 N·m for the series 7/16.

However, the tightening torque applied could have a tendency to relax over time, and cause the electrical performance levels associated with the connectors to change. And, the dimensions of these connectors are large.

New coaxial power connectors have been recently developed with high RF performance levels, notably with a very low passive intermodulation. These connectors are those marketed under the series 4.3-10 and are specified in the standard project IEC 61169-54.

Such a coaxial connection system is shown on FIG. 2. An O-ring seal 6 is preferably arranged at the periphery of the rigid ground contact 21. The same elements than described previously are designated by the same reference signs. In this system, an axial operating play (axial gap) J remains between ground contacts 21, 31 on the axis X, once the locking is done. The electrical ground connection between ground contacts 21, 31 is thus produced only by the radial bearing of the elastic ground contact 31 against the interior of the recess of the rigid ground contact 21. The dimensions of these connectors are smaller than the 7/16 connectors.

However, such a system marketed under the series 4.3-10 designation, presents some major inconvenients. Firstly, it is provided no solid insulating structure between the elastic outer contact 31 and the center contact 30 of the jack 3. Consequently, they are not physically protected during the mating/unmating of the two connectors, and notably it is possible to damage the elastic outer contact 31. This is not a guarantee of a connector (jack) with a long life. And, in case of a deformation and/or damage of the elastic contact 31, the dynamic intermodulation is not stable.

Moreover, the ground contact 21 of the plug 2 has a cylindrical outer surface forming a guiding portion 210 of diameter D and a length L along the axis X, which is mechanically guided against the guiding portion 320 of the body 32 of the jack 3, during the connection. In order to facilitate the connection, the ground contact 21 presents at its free extremity a chamfer, which noticeably reduce the guiding zone. Thus, the ratio L/D is on the order of 0.3 only. Due to that, the stability between the connectors is low such that a good coaxiality cannot be ensured. This implies also a decrease of the performances of the dynamic intermodulation.

Moreover, the low ratio L/D and a slotted elastic ground contact 31 without insulation support protection for the jack 3 allow a risk in the connexion. This risk may induce a break of the system or may induce the deformation of the petal 310 of the slotted ground contact 31 of the jack 3 during the mating/unmating operations, such as shown in FIG. 2A. This deformation would strongly impact the passive intermodulation properties of the system without being visually easily visible.

There is therefore a need to further improve the RF connection systems of coaxial type, with high RF performances, more specifically with a low passive intermodulation level and a stable dynamic intermodulation level.

The invention aims to address all or some of this need.

Explanation of the Invention

The subject of the invention is thus a coaxial connection system, intended to transmit radio frequency RF signals, of longitudinal axis X, comprising a first system element forming a plug and a second system element forming a jack, the plug and the jack each comprising:

- a central contact,
- a peripheral contact, arranged on the periphery of the central contact, forming a ground contact,
- a solid insulating structure interposed between the central contact and the ground contact.

The jack comprises a body having a cylindrical inner surface forming a guiding portion.

According to the invention, one of the ground contact is elastic and comprises a slotted sleeve, whereas the other cooperating ground contact is rigid, the elastic one bearing radially against the inner surface of the rigid one in connection configuration between the plug and the jack.

Also according to the invention, the outer surface of the outer contact of the plug is forming a guiding portion which is mechanically guided against the guiding portion of the body of the jack, during the connection, said guiding portion of the ground contact of the plug having a diameter D and a length L along the axis X, defining a ratio L/D which is superior or equal to 0.5.

Thus, the invention mainly consists in the use of solid insulating structures and in a lengthening of the guide portion of the connectors, while ensuring an axial immobilization of the ground contacts independently of the locking device that mechanically locks the plug to the jack when they are in mutual connection configuration.

The use of a solid insulating structure, especially in the jack, avoids the undesired deformation of the elastic outer contact and/or the center contact. This mechanical protection guarantees a long life for the connection system and a stable dynamic intermodulation. It has to be understood that in the framework of the invention, the solid insulating structure is different from air only, which is an insulating as well. On the contrary, the solid insulating structure according to the invention is made of a solid piece which must be strong enough to protect the slotted ground contact. This solid piece may be full of material or eventually with internal holes or one or more hollowness. In this embodiment, the solid piece with internal holes has to fulfill the requirement of protecting the slotted ground contact.

Compared to all the connectors of the prior art such as described in the preamble, in particular those under the designations series 7-16 and series 4.3-10, a longer length of the guiding portion of the plug associated with a low radial gap with the guiding portion of the body of the jack keeps the connection stable with a stable coaxiality. This allows a very low and stable passive intermodulation level for the connection system according to the invention.

In a preferred embodiment, the dimensions of the coaxial connection system according to the invention is of the same order than the dimensions of the prior art connectors known under the designation QMA series (proprietary interface), and smaller than the one of the 7/16 series connectors.

As a sum up, a connection system according to the invention exhibits high RF performance levels, in particular with low passive and dynamic intermodulation levels, those are stable over time.

Preferably, the difference (E), namely the radial clearance, between the diameter of the guiding portion of the body of the jack and the diameter D of the guiding portion of the ground contact of the plug is sized such that the ratio E/L is inferior to 0.05, preferably inferior to 0.03.

Alternatively or in combination with the preceding feature, the difference (E), namely the radial clearance, between the diameter of the guiding portion of the body and the diameter D of the guiding portion of the ground contact of the plug is sized such the tilting angle between the jack and the plug, in their mutual connection configuration, inferior to 3°, preferably inferior to 1.5°.

In an advantageous embodiment, the value of the tilting angle keeps below 3°, preferably below 1.5°, up to the full disconnection of the guiding portions one from the other, during the unmating of the plug from the jack. Thanks to this feature, the slotted ground contact is mechanically protected without fail during the unmating operation.

In another advantageous embodiment, the system comprises a locking device suitable for mechanically locking the plug to the jack when they are in mutual connection configuration.

In a first variant, the locking device may be of screw/nut type and consisting of a nut mounted free in rotation around the plug and a screw, the threads of which are formed on the periphery of the body of the jack.

In a second variant, the locking device may be of snap-lock type and comprising a coupling ring mounted around the plug, the coupling ring having at least a latching hook which are adapted to snap into a groove formed at the periphery of the body of the jack in the connection configuration, the snapping being carried out during the connection.

Preferably, the snap-lock device may comprises a unlocking nut which is mounted free in translation around the plug, the unlocking nut having a surface protruding to the inside and adapted to disengage the hooks from the peripheral groove of the body of the jack, upon movement of the cap nut in the opposite direction of the connection direction.

DETAILED DESCRIPTION

Other advantages and features of the invention will become more apparent on reading the detailed description of exemplary implementations of the invention, given as illustrative and non-limiting examples with reference to the following figures in which.

Figure 1:
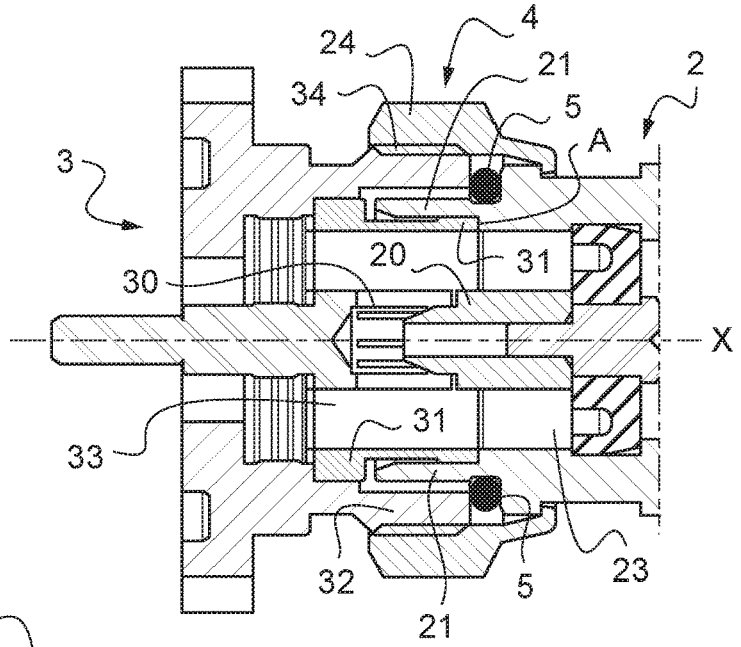
Fig.1 (PRIOR ART)
FIG. 1 is a longitudinal cross-sectional view of a coaxial power and low passive intermodulation connection system series 7/16, according to the prior art, the plug and the jack being in mutual connection and locking configuration.
Figure 2:
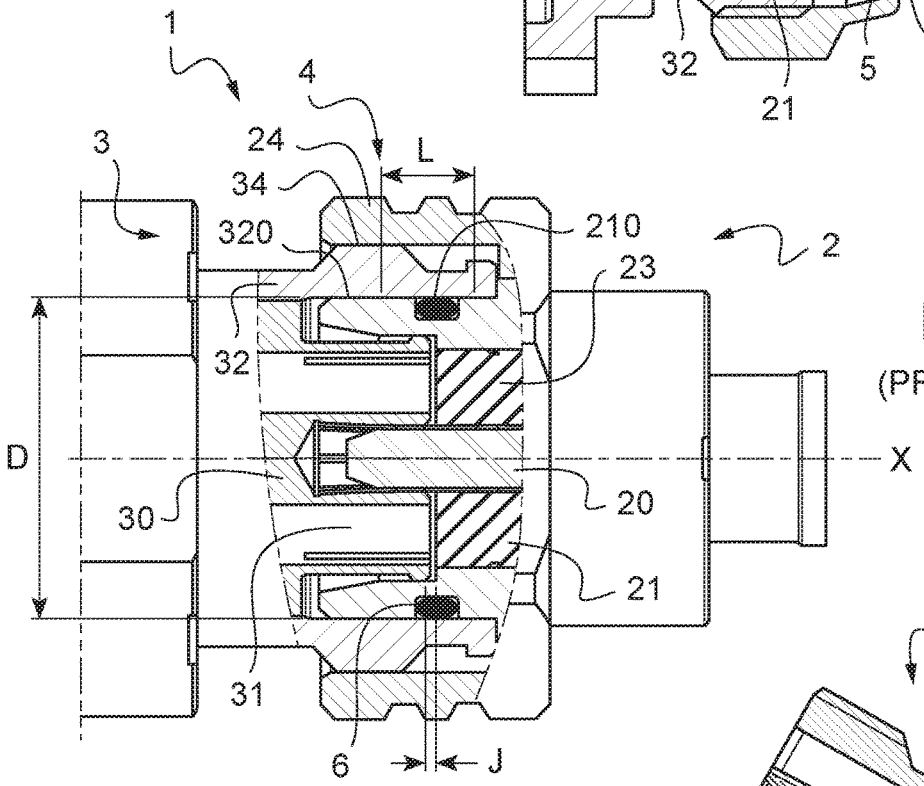
Fig.2 (PRIOR ART)
FIG. 2 is a longitudinal cross-sectional view of a coaxial connection system according to the prior art, marketed under the series 4.3-10, the plug and the jack being in mutual connection and locking configuration.
Figure 2A:
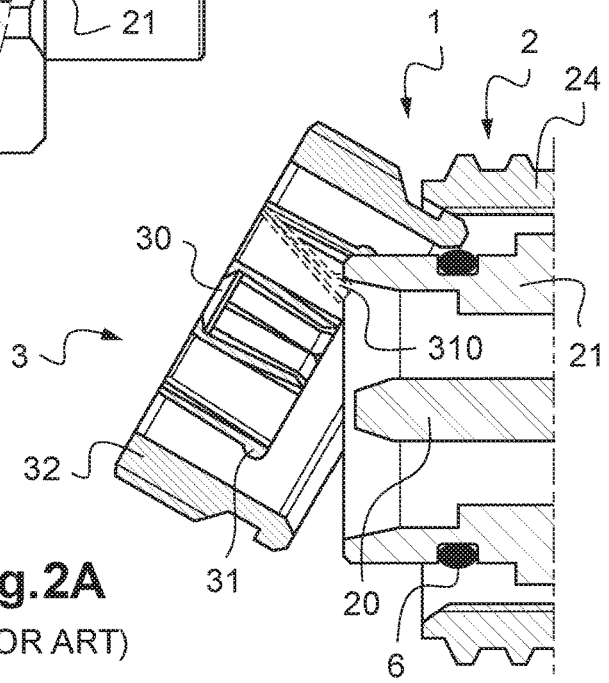
Fig.2A (PRIOR ART)
FIG. 2A shows the mating risk induced in the system in FIG. 2.

FIGS. 1 to 2A relate to different examples of coaxial connection systems according to the prior art.

These FIGS. 1 to 2A have already been commented on in the preamble and will not therefore be commented on further herein below.

In the interests of clarity, the same references designating the same elements of a connection system according to the prior art and of a connection system according to the invention are used for all the FIGS. 1 to 5A.

Hereinafter, the invention is described with reference to any type of RF line.

In the coaxial connection system according to the invention 1, each of the plug 2 and the jack 3 comprises a solid insulating structure 23, 33 interposed between the central contact 20, 30 and the ground contact 21, 31. Thus, compared to a connector marked under series 4.3-10, as shown on FIG. 2, the jack 3 includes a solid insulating structure 33 between the central contact 30 and the ground contact 31. This solid insulating structure 33 protects physically the female center contact 30 and the slotted elastic ground contact 31 during the mating (connection). Besides, it avoids the risk of accidental damages due to the intrusion of external objects.

As shown on FIGS. 3, 3A, 3B, 4A and 5A, the jack 3 according to the invention comprises a body 32 having a cylindrical inner surface forming a guiding portion 320.

Figure 3:
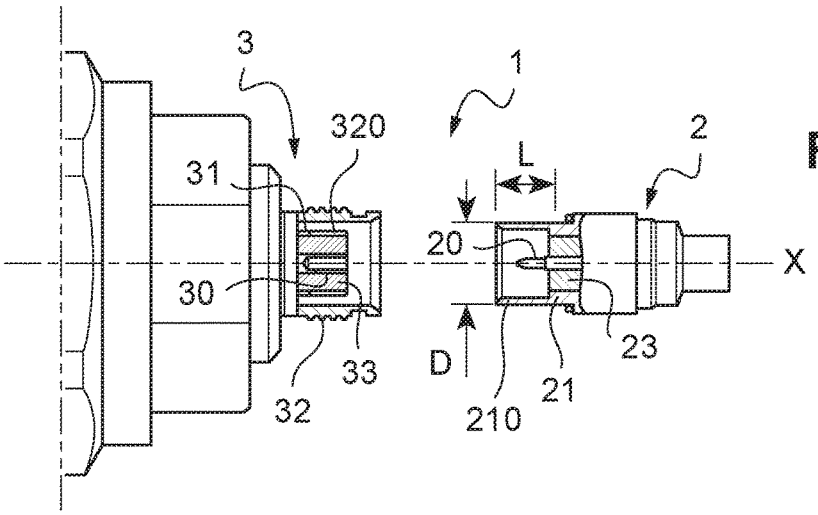
FIG. 3 is in longitudinal cross section a coaxial connection system according to the invention, the plug and the jack being in a ready position to be connected.
Figure 3A:
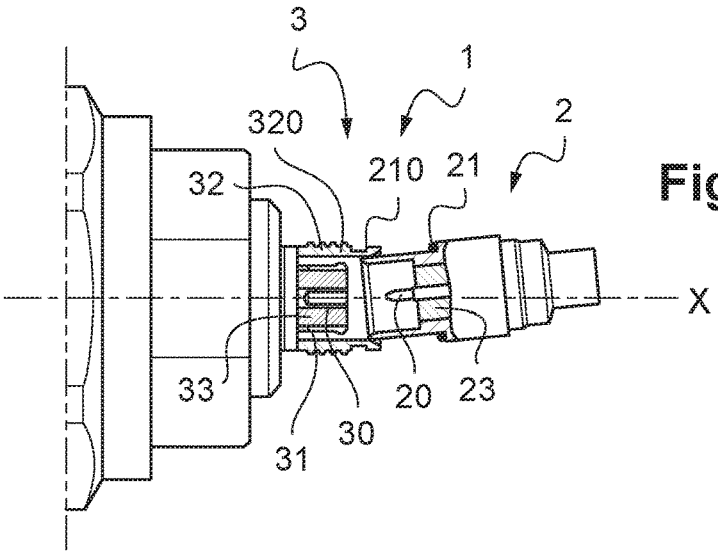
FIG. 3A shows the position of the beginning of the mating of the plug into the jack of the coaxial connection system of the FIG. 3.
Figure 3B:
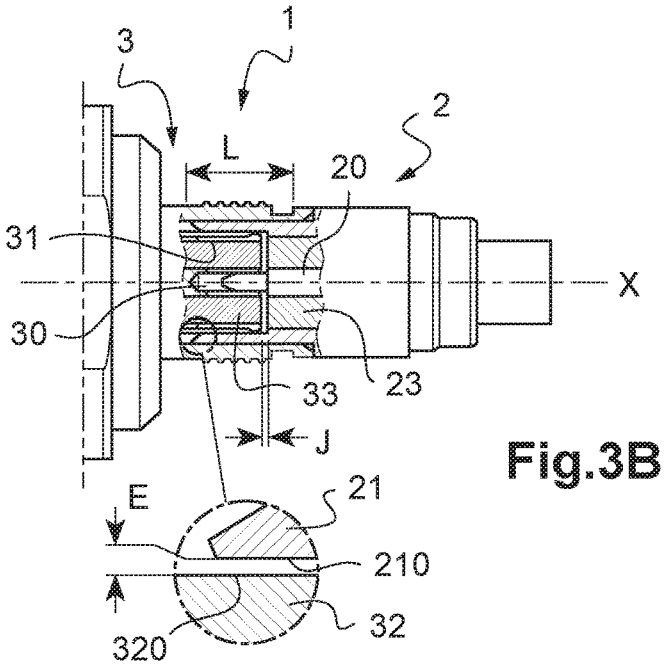
FIG. 3B shows the mutual connection of the plug into the jack of the coaxial connection system of the FIG. 3.
Figure 4:
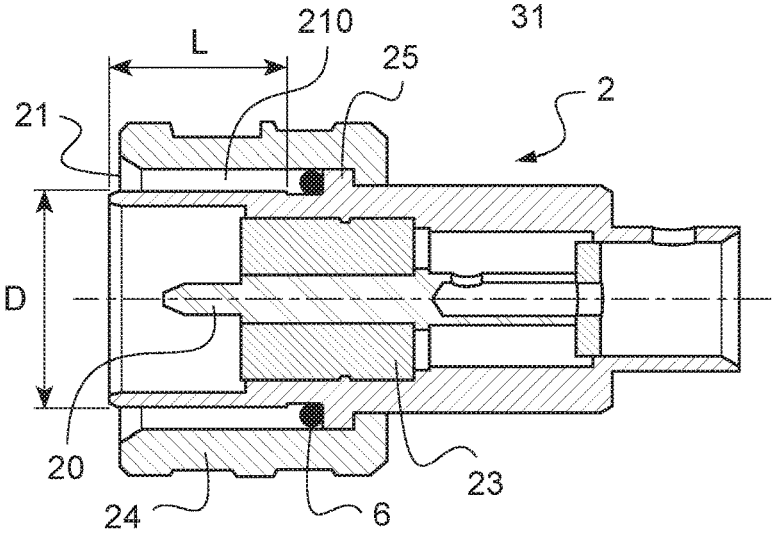
FIG. 4 is a longitudinal cross section view of a plug of a coaxial connection system according to the invention, equipped with a nut of a locking device of screw/nut type.
Figure 4A:
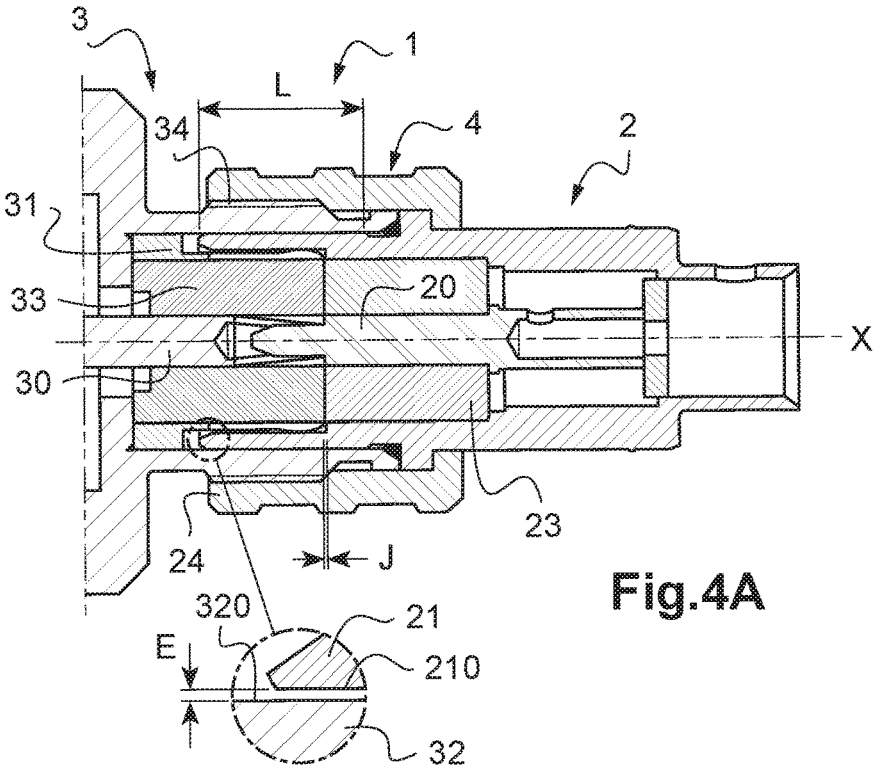
FIG. 4A is a longitudinal cross-sectional view of a coaxial connection system according to the invention using the plug according to FIG. 4, the plug and the jack being in mutual connection and locking configuration.
Figure 5:
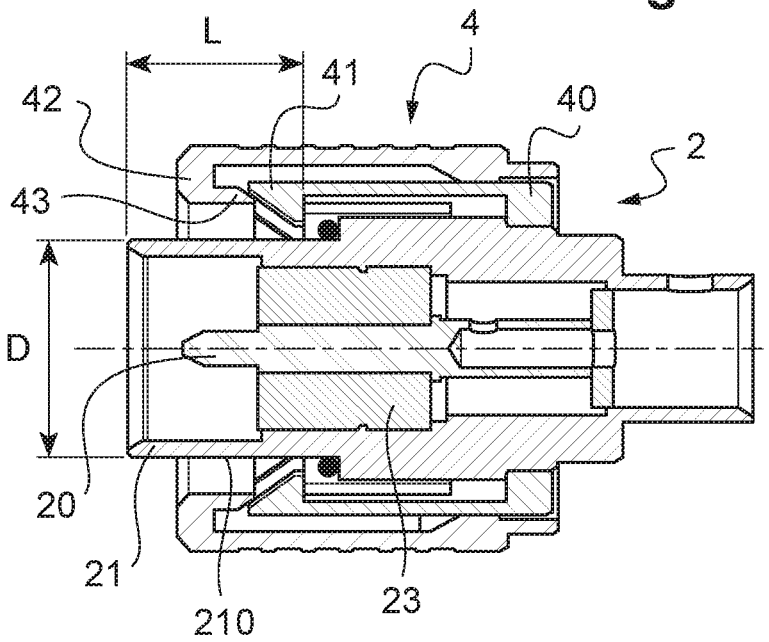
FIG. 5 is a longitudinal cross section view of a plug of a coaxial connection system according to the invention, equipped with a coupling nut and a coupling ring of a locking device of snap-lock type.
Figure 5A:
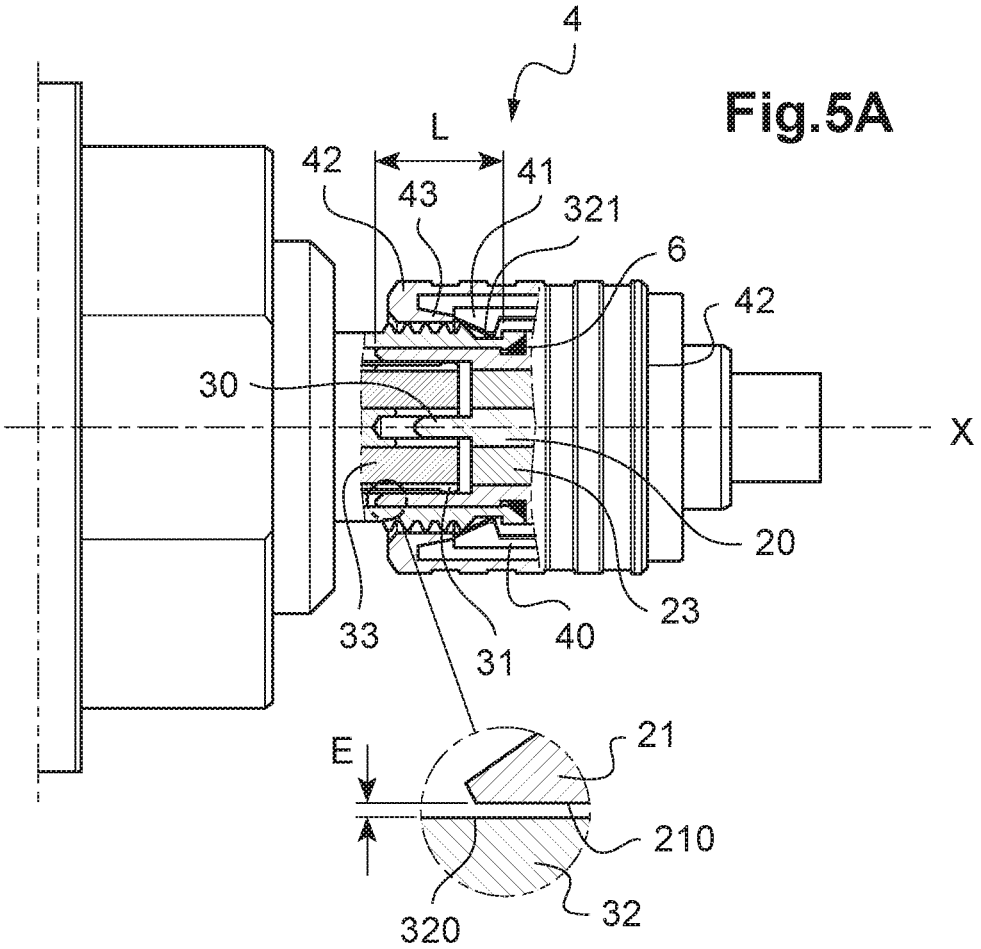
FIG. 5A is a longitudinal cross-sectional view of a coaxial connection system according to the invention using the plug according to FIG. 5, the plug and the jack being in mutual connection and locking configuration.

In the coaxial connection system 1 according to the invention, the free end of the body 32 is in longitudinal mechanical abutment against a part 25 of the plug 2 when they are in mutual connection configuration, such that it is provided a minimum axial gap (J) between ground contacts along the axis X (FIGS. 3B, 4A, 5A). In the shown embodiments, the part 25 of the plug which forms an abutment is a shoulder provided at the periphery of the plug 2. In the snap-lock configuration, the final axial gap (J) when fully mated is provided through the abutment of the hook 41 in the groove 321 and the free end of the body 32 against the O-ring seal 6.

According to the invention and shown on FIGS. 3 to 5A, the sizing has be made such that the guiding portion 210 has a diameter D and a length L along the axis X, defining a ratio L/D which is superior or equal to 0.5. For example in the shown embodiment, the ratio L/D is equal to 0.55. By comparison, this ratio L/D is of the order of 0.3 only in the 4.3-10 series.

Compared to all the coaxial connecting systems of the prior art, the length of the guiding, which is active from the beginning of the connection is increased in a substantive manner.

The inventors have analysed that such a big length L for the guiding portion with a high ratio L/D, combined with a low radial gap (radial clearance) E between the diameter of the guiding portion 320 of the body 32 and the diameter D of the guiding portion 210 of the plug 2 leads to a possible transverse tilt, which is low and a higher stability, namely a better coaxiality of the connection. Accordingly, the passive intermodulation is lower compared to the coaxial connection systems of the prior art.

Preferably, the sizing is such that the tilting angle $\alpha$ between the jack 3 and the plug 2, in their mutual connection configuration is inferior to 3°, preferably inferior to 1.5°. Alternatively and/or in combination with, the sizing is such that the ratio E/L is inferior to 0.05, preferably inferior to 0.03.

Moreover, in the coaxial connection system 1 according to the invention, the electrical ground path is made between the part 31, more specifically between the bump at the free end of the part, and the internal surface of the complementary body 21 (FIG. 3B). On the other hand, the mechanical guiding is done by the guiding portions 210 and 320.

Figure 3C:
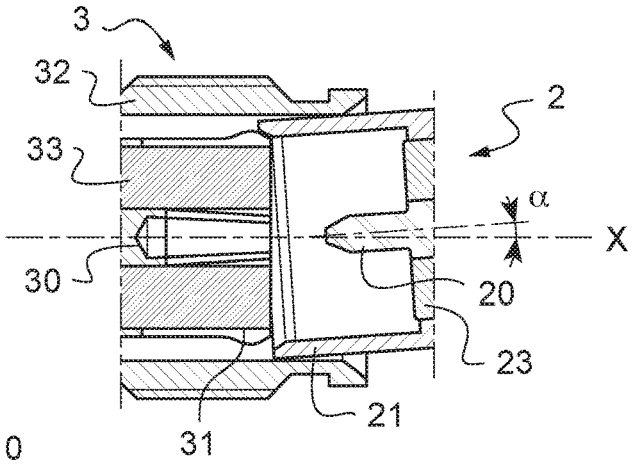
FIG. 3C shows the maximum allowable tilting angle during the mating and unmating phases of the plug into the jack of the coaxial connection system of the FIG. 3.

Due to the recess of the ground contact 31 to the portion 320, the mechanical guiding provides a better alignment before the connection of the electrical contact. (FIG. 3C). The value of the tilting angle $\alpha$ between the jack and the plug keeps below 7°, when the slotted ground contact 31 just connects the inner surface of the rigid one 21 during the mating or, when the slotted ground contact 31 disconnects the inner surface of the rigid one 21 during the unmating. Therefore, the electrical ground contact is protected from repetitive mating/unmating operations and consequently, the intermodulation is lower and more stable.

FIGS. 4 to 4A show a first variant of a locking device 4 suitable for mechanically locking the plug 2 to the jack 3 when they are in mutual connection configuration. In this illustrated variant, the locking device 4 is of screw/nut type. After the mutual connection has been achieved, a nut 24 which mounted free in rotation around the plug 2 is screwed onto threads 34 formed on the periphery of the body 32 of the jack 3. The locking configuration is thus achieved.

FIGS. 5 to 5A show a second variant of a locking device 4 which is here of a snap-lock type. At the end of the mutual connection, the peripheral portion of the body 32 moves apart radially some latching hooks 41 of a coupling ring 40 mounted around the plug 2 and then, the hooks 41 are snapped into a groove 321 of the body 32.

To unlock the plug 2 from the jack 3, the device 4 comprises an unlocking nut 42 which is mounted free in translation around the plug 2, the unlocking nut having a surface 43 protruding to the inside. Thus, upon movement of the nut 42 in the opposite direction of the connection direction, the surface 43 will disengage the hooks 41 from the peripheral groove 321 of the body 32 of the jack 3.

The advantages of a coaxial connection system 1 according to the invention, which has just been described, are numerous compared to a coaxial connection system according to the prior art, such as the one marketed under the designation series 7/16 or under the designation 4.3-10 or such as disclosed in the WO2014/026383 patent application:

- a sure mechanical protection of both elastic outer contacts and center contacts;
- high RF signal transmission performance levels maintained, even increased, with in particular a low and stable over time of passive and dynamic intermodulation levels;
- miniaturization of the connection compared to low passive intermodulation connectors of the prior art.

Other variants and enhancements can be provided without in any way departing from the framework of the invention.

The expression "comprising a" should be understood to be synonymous with "comprising at least one", unless otherwise specified.

The invention claimed is:

1. A coaxial connection system, intended to transmit radio frequency RF signals, of longitudinal axis X, comprising a first system element forming a plug and a second system element forming a jack, the plug and the jack each comprising:

a central contact, a peripheral contact, arranged on the periphery of the central contact, forming a ground contact, a solid insulating structure interposed between the central contact and the ground contact, in which the jack comprises a body having a cylindrical inner surface forming a guiding portion, wherein the ground contact of one of the plug and the jack is elastic and comprises a slotted sleeve having a free end, whereas the ground contact of the other of the plug and the jack is rigid and comprises a base and a cylindrical outer surface projecting from the base, the elastic ground contact bearing radially against the inner surface of the rigid ground contact in connection configuration between the plug and the jack with a minimum axial gap along the axis X between the free end of the slotted sleeve and the base of the rigid ground contact and between the solid insulating structure of the plug and the solid insulating structure of the jack;

wherein the solid insulating structure of the jack physically protects the central contact of the jack and the slotted elastic ground contact of the jack during a mating connection;

and wherein the outer surface of the ground contact of the plug is forming a straight, single-segment guiding portion which is mechanically guided against the guiding portion of the body of the jack, during the connection, said guiding portion of the ground contact of the plug having a diameter D and a length L along the axis X, defining a ratio L/D which is superior or equal to 0.5 in order to restrict any angular misalignment before the mating connection.

2. A coaxial connection system according to claim 1, wherein the guiding portion of the body has a diameter, the diameter of the guiding portion of the body and the diameter D of the guiding portion of the ground contact of the plug defining a difference (E), namely a radial clearance, which defines a ratio E/L which is inferior to 0.05 and larger than 0.

3. A coaxial connection system according to claim 1, wherein the jack and the plug define a tilting angle ($\alpha$) in their mutual connection configuration and the guiding portion of the body has a diameter, the diameter of the guiding portion of the body and the diameter D of the guiding portion of the ground contact of the plug defining a difference (E), namely a radial clearance, which is sized such that the tilting angle ($\alpha$) is inferior to 3°.

4. A coaxial connection system according to claim 3, wherein the value of the tilting angle ($\alpha$) between the jack and the plug keeps below 7°, when the slotted ground contact just connects the inner surface of the rigid one during the mating or, when the slotted ground contact disconnects the inner surface of the rigid one during the unmating.

5. A coaxial connection system according to claim 1, wherein the solid insulating structure presents holes or one or more hollowness.

6. A coaxial connection system according to claim 1, comprising a locking device suitable for mechanically locking the plug to the jack when they are in mutual connection configuration.

7. A coaxial connection system according to claim 6, wherein said locking device is of screw/nut type and consisting of a nut mounted free in rotation around the plug and a screw, the threads of which are formed on the periphery of the body of the jack.

8. A coaxial connection system according to claim 6, wherein said locking device is of snap-lock type and comprising a coupling ring mounted around the plug, the coupling ring having at least a latching hook which are adapted to snap into a groove formed at the periphery of the body of the jack in the connection configuration, the snapping being carried out during the connection.

9. A coaxial connection system according to claim 8, wherein the snap-lock device comprises a unlocking nut which is mounted free in translation around the plug, the unlocking nut having a surface protruding to the inside and adapted to disengage the hooks from the peripheral groove of the body of the jack, upon movement of the nut in the opposite direction of the connection direction.

* * * * *